US011643709B2

(12) United States Patent
Kai et al.

(10) Patent No.: US 11,643,709 B2
(45) Date of Patent: May 9, 2023

(54) METHOD AND APPARATUS FOR PREPARING ALUMINUM MATRIX COMPOSITE WITH HIGH STRENGTH, HIGH TOUGHNESS, AND HIGH NEUTRON ABSORPTION

(71) Applicant: Jiangsu University, Jiangsu (CN)

(72) Inventors: Xizhou Kai, Jiangsu (CN); Yutao Zhao, Jiangsu (CN); Yanjie Peng, Jiangsu (CN); Gang Chen, Jiangsu (CN); Xiaojing Xu, Jiangsu (CN); Lin Wu, Jiangsu (CN); Shuoming Huang, Jiangsu (CN); Ruikun Chen, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/630,169

(22) PCT Filed: Oct. 22, 2020

(86) PCT No.: PCT/CN2020/122688
§ 371 (c)(1),
(2) Date: Jan. 26, 2022

(87) PCT Pub. No.: WO2021/143247
PCT Pub. Date: Jul. 22, 2021

(65) Prior Publication Data

US 2022/0282356 A1 Sep. 8, 2022

(30) Foreign Application Priority Data

Jan. 19, 2020 (CN) ..... 202010060933.5

(51) Int. Cl.
*C22C 21/00* (2006.01)
*C22C 1/10* (2023.01)
*C22C 32/00* (2006.01)

(52) U.S. Cl.
CPC ..... *C22C 21/00* (2013.01); *C22C 1/1068* (2013.01); *C22C 32/0057* (2013.01); *C22C 1/1052* (2023.01)

(58) Field of Classification Search
None
See application file for complete search history.

(56) References Cited

U.S. PATENT DOCUMENTS 7,288,133 B1 10/2007 Peng et al.

FOREIGN PATENT DOCUMENTS

CN 101391290 3/2009
CN 101775518 7/2010
(Continued)

OTHER PUBLICATIONS

"International Search Report (Form PCT/ISA/210) of PCT/CN2020/122688" dated Jan. 20, 2021, with English translation thereof, pp. 1-5.

*Primary Examiner* — George Wyszomierski
*Assistant Examiner* — Janell C Morillo
(74) *Attorney, Agent, or Firm* — JCIPRNET

(57) ABSTRACT

The present invention relates to an aluminum matrix composite (AMC), and particularly to a method and apparatus for preparing an AMC with a high strength, a high toughness, and a high neutron absorption. The present invention combines a high-neutron-absorption and highly stable micro-$B_4C$ extrinsic reinforcement with an in-situ nano-reinforcement containing elements B, Cd, and Hf and having high neutron capture ability, achieves efficient absorption of neutrons by using the large cross-sectional area of the micro-reinforcement, achieves effective capture of rays penetrating gaps of the micro-reinforcement by means of the highly dispersed in-situ nano-reinforcement, and significantly improves the toughness of the composite material by
(Continued)

means of the high-dispersion toughening effect of the nano-reinforcement, obtaining a particle-reinforced aluminum matrix composite (PAMC) having high toughness and high neutron absorption.

6 Claims, 2 Drawing Sheets

(56) References Cited

FOREIGN PATENT DOCUMENTS

| | | | |
|---|---|---|---|
| CN | 103789599 | 5/2014 | |
| CN | 104928542 | 9/2015 | |
| CN | 109797309 | 5/2019 | |
| CN | 110016582 | 7/2019 | |
| CN | 111118329 | 5/2020 | |
| WO | WO-2010051675 A1 * | 5/2010 | ..... B22D 1/00 |

* cited by examiner

METHOD AND APPARATUS FOR PREPARING ALUMINUM MATRIX COMPOSITE WITH HIGH STRENGTH, HIGH TOUGHNESS, AND HIGH NEUTRON ABSORPTION

CROSS-REFERENCE TO RELATED APPLICATION

This application is a 371 of international application of PCT application serial no. PCT/CN2020/122688, filed on Oct. 22, 2020, which claims the priority benefit of China application no. 202010060933.5, filed on Jan. 19, 2020. The entirety of each of the above mentioned patent applications is hereby incorporated by reference herein and made a part of this specification.

BACKGROUND

Technical Field

The present invention relates to an aluminum matrix composite (AMC), and in particular to a method and apparatus for preparing an AMC with high strength, high toughness, and high neutron absorption.

Description of Related Art

Particle-reinforced aluminum matrix composites (PAMCs) have excellent properties such as high thermal conductivity, low expansibility, high specific strength, and high elasticity modulus, and have promising application prospects. Among PAMCs, $B_4C$-reinforced AMCs have been widely used in nuclear energy-related industries due to their excellent neutron absorption properties. However, like traditional particle-reinforced metal materials, the plasticity and toughness of these material will be greatly reduced after their structural functions are enhanced.

The in-situ synthesis process of AMC is a new technology developed in recent years. In-situ PAMCs have the advantages of small reinforcement size, excellent thermal stability, and high interfacial bonding strength (IBS), and are widely used in industrial fields such as aviation, aerospace, automobile, and machinery. Some studies in recent years have shown that, when a reinforcement particle size is reduced to a nanoscale, a surface area of nanoparticles per unit volume increases sharply and a compound reinforcement effect is greatly improved, such that a nanoparticle-reinforced AMC has high specific strength, specific modulus, and high temperature resistance, and an in-situ nano-reinforcement with B, Cd, and Hf elements has excellent neutron absorption properties. Therefore, it is of important research significance to study the preparation of a micron-$B_4C$ reinforcement and an in-situ nano-reinforced AMC with B, Cd, and Hf elements.

However, the current $B_4C$ and in-situ nano-reinforced AMCs face some serious problems: (1) $B_4C$ reinforcement particles are difficult to infiltrate a matrix and are prone to an interfacial reaction. (2) Due to the huge interfacial energy of nanoparticles, nanoparticles generated in situ tend to agglomerate, resulting in problems such as low strength and toughness of a composite.

SUMMARY

The present invention is intended to solve the problems in the art that $B_4C$ reinforcement particles are difficult to infiltrate into a matrix and are prone to interfacial reactions, nanoparticles in an in-situ nanoparticle-reinforced AMC tend to agglomerate; as-cast grains have a relatively-large size, and nanoparticles only lead to limited strength improvement; and provide a method and apparatus for preparing an AMC with high strength, high toughness, and high neutron absorption. The present invention promotes the infiltration of $B_4C$ reinforcement particles in a matrix, fully alleviates the agglomeration of nanoparticles to allow the uniform distribution of nanoparticles, greatly refines grains of the AMC, and greatly improves the strength and toughness of the composite.

In the present invention, a micro-$B_4C$ extrinsic reinforcement with high neutron absorption and high stability is combined with a B, Cd, and Hf-containing in-situ nano-reinforcement with high neutron capture ability. The large cross-sectional area of the micro-reinforcement helps to achieve the efficient absorption of neutrons, the highly-dispersed in-situ nano-reinforcement helps to achieve the effective capture of rays passing through micro-reinforcement gaps, and the high dispersion, strengthening, and toughening of the nano-reinforcement help to significantly improve the strength and toughness of the composite, such that the PAMC with high strength, high toughness, and high neutron absorption is obtained.

The present invention adopts an integrated composite preparation apparatus that is independently designed and couples a radial magnetic field and an ultrasonic field. The combination of the radial magnetic field and the ultrasonic field makes components uniform and promotes the infiltration of the $B_4C$ reinforcement particles into the matrix and the in-situ nanocomposite to obtain the PAMC with high strength, high toughness, and excellent neutron absorption in which components are uniformly distributed and $B_4C$ particles are well bonded to the aluminum matrix.

The integrated composite preparation apparatus that couples a radial magnetic field and an ultrasonic field designed in the present invention is an integrated composite apparatus composed of an electromagnetic induction heating device, a radial magnetic field device, and an ultrasonic device.

The integrated composite preparation apparatus that couples a radial magnetic field and an ultrasonic field includes an electromagnetic induction heating device, a radial magnetic field device, an ultrasonic device, and a crucible, where the crucible is arranged inside the electromagnetic induction heating device, the radial magnetic field device is arranged peripherally outside the electromagnetic induction heating device, and the ultrasonic device is arranged at a bottom of the integrated composite preparation apparatus.

Two air outlets and one feed pipe are provided at a top of the composite preparation apparatus.

An argon ventilation pipe is provided on an upper part of each of two outer sides of the composite preparation apparatus.

A melting furnace protective layer is provided at the bottom of the composite preparation apparatus to wrap a main body of the ultrasonic device except an amplitude transformer, the amplitude transformer extends into the crucible, and a discharge port is formed at a side of a bottom of the crucible, and the discharge port is led out from the melting furnace protective layer.

A method for preparing a PAMC with high strength, high toughness, and high neutron absorption based on the designed integrated composite preparation apparatus that couples a radial magnetic field and an ultrasonic field is provided, where through a siphon channel in the center of a melt surface generated by a radial magnetic field, a micro-$B_4C$ extrinsic ceramic reinforcement and an intermediate alloy or compound with B, Cd, Hf, Ti, and Zr are introduced into a melt, and a high temperature and a high pressure caused by cavitation and acoustic streaming generated by a high-energy ultrasonic field below a liquid surface of the siphon channel help to achieve the infiltration and dispersion of micro-$B_4C$ and promote the in-situ generation of a nano-reinforcement from the intermediate alloy or compound with B, Cd, Hf, Ti, and Zr and the uniform dispersion of the nano-reinforcement, such that the AMC reinforced by a cross-scale hybrid of an extrinsic micro-reinforcement and an in-situ nano-reinforcement is prepared.

The preparation method based on the designed integrated composite preparation apparatus that couples a radial magnetic field and an ultrasonic field specifically includes the following steps.

Step 1: melting a matrix aluminum alloy in the crucible of the integrated composite apparatus at 850° C. to 950° C.

Step 2: turning on the radial magnetic field device and the ultrasonic device of the composite apparatus, and adding reactants mixed in a predetermined ratio through the feed pipe to conduct a reaction for 20 min to 30 min to generate in-situ nanoparticles.

Step 3: cooling the melt to 780° C. to 800° C., adding $B_4C$ microparticles through the feed pipe, and applying a strong radial magnetic field and a strong ultrasonic field to promote the infiltration and dispersion of the $B_4C$ microparticles in the composite melt; and stirring for 10 min to 30 min, cooling to 720° C. to 750° C., and casting.

The integrated composite preparation apparatus that couples a radial magnetic field and an ultrasonic field is composed of an electromagnetic induction heating device, an ultrasonic device, and a radial magnetic field device. The aluminum alloy is heated by the electromagnetic induction heating device, and the radial magnetic field device and the ultrasonic device are used to promote the synthesis of the in-situ nanoparticles and the infiltration and dispersion of the $B_4C$ particles.

The siphon channel in the center of the melt surface generated by the radial magnetic field is generated due to flow inside the melt caused by the radial magnetic field. The radial magnetic field has a power of 80 kW to 160 kW and a current of 10 A to 100 A, and the siphon channel has a depth of 5 cm to 15 cm.

The high-energy ultrasonic field is generated by the ultrasonic device at the bottom of the composite apparatus, with an ultrasonic power of 5 kW to 20 kW, and the amplitude transformer has a length of 10 cm, and there is a distance of 8 cm to 15 cm between a top of the amplitude transformer and a bottom of the siphon channel.

The micro-$B_4C$ powder of the micro-$B_4C$ extrinsic ceramic reinforcement with high neutron absorption and high stability refers to $B_4C$ microparticles with a $B_4C$ content of 98.8 wt % or more and an average particle size of 10 μm to 300 μm, and a volume fraction of the $B_4C$ microparticles in the AMC is 5 vol % to 30 vol %.

The in-situ nano-reinforcement with B, Cd, Hf, Ti, and Zr includes one or more selected from the group consisting of $ZrB_2$, $TiB_2$, CdB, and $HfB_2$ that are generated by introducing different intermediate alloys or reactants in the melt for an in-situ reaction, which has a particle size of 2 nm to 100 nm, and a volume fraction of the in-situ nanoparticles in the AMC is 0.2 vol % to 25 vol %.

The matrix aluminum alloy in step 1 is selected from the group consisting of pure aluminum and different 2 series, 5 series, 6 series, and 7 series aluminum matrices according to different uses of thermal conduction, electric conduction, high strength, low expansion, and wear resistance, and typical representatives are pure aluminum, 2024, 6061, 6063, 6082, 6016, 6111, 7055, A356, A380, AlSi9Cu3, and the like.

In step 2, a feed speed of the feed pipe is controlled at 5 g/min to 50 g/min by a mechanical device.

The melting at 850° C. to 950° C. in step 2 is adjusted according to a specific reaction system, the in-situ reaction is conducted for 20 min to 30 min to introduce the element compound for forming the nano-reinforcement particles into the melt, and the reaction is accompanied by radial cyclic stirring, such that the nano-reinforcement is synthesized in-situ in the melt, and the intermediate alloy or element compound for forming the nano-reinforcement particles includes one or more selected from the group consisting of Al—Zr, Al—Ti, Al—B, Al—Cd, Al—Hf, $K_2ZrF_6$, $K_2TiF_6$, $KBF_4$, $Na_2B_4O_7$, $ZrO_2$, and $B_2O_3$.

The crucible is made of a heat-resistant die steel undergoing a surface passivation treatment, such as H13 steel, high-speed steel, and high-Gr steel, and the amplitude transformer is made of a high-temperature and corrosion-resistant niobium alloy.

In the present invention, a micro-$B_4C$ extrinsic reinforcement with high neutron absorption and high stability is combined with a B, Cd, and Hf-containing in-situ nano-reinforcement with high neutron capture ability. The large cross-sectional area of the micro-reinforcement helps to achieve the efficient absorption of neutrons, the highly-dispersed in-situ nano-reinforcement helps to achieve the effective capture of rays passing through micro-reinforcement gaps, and the high dispersion, strengthening, and toughening of the nano-reinforcement help to significantly improve the strength and toughness of the composite, such that the PAMC with high strength, high toughness, and high neutron absorption is obtained.

DESCRIPTION OF THE EMBODIMENTS

The present invention can be implemented according to the following examples, but is not limited to the following examples. These examples are used only to illustrate the present invention, but not to limit the scope of the present invention in any way. In the following examples, various processes and methods that are not described in detail are conventional methods known in the art.

Example 1

$K_2ZrF_6$ and $KBF_4$ were used as reactants and mixed in a chemical ratio enabling the production of 1 vol % $ZrB_2$ nanoparticles, then ground, and dried at 200° C. for 2 h to obtain a mixed reactant powder. Pure aluminum was placed in a crucible and heated by an induction coil for melting, and after the temperature reached 870° C., the mixed reactant powder was added. A radial magnetic field device and an ultrasonic device were turned on with a radial magnetic field power of 120 kW, a current of 50 A, and an ultrasonic field power of 15 kW to conduct a reaction for 30 min. After a melt was cooled to 780° C. to 800° C., $B_4C$ particles with an average particle size of 20 μm were added at a speed of 20 g/min, and after a reaction was completed, a resulting melt was allowed to stand, then subjected to gas removal and slag removal, cooled to 720° C., and casted to finally obtain a (5 vol % $B_4C$+1 vol % $ZrB_2$)/Al composite. The composite had a tensile strength of 210 MPa, a yield strength of 120 MPa, and an elongation at break of 23.5%.

Figure 1:
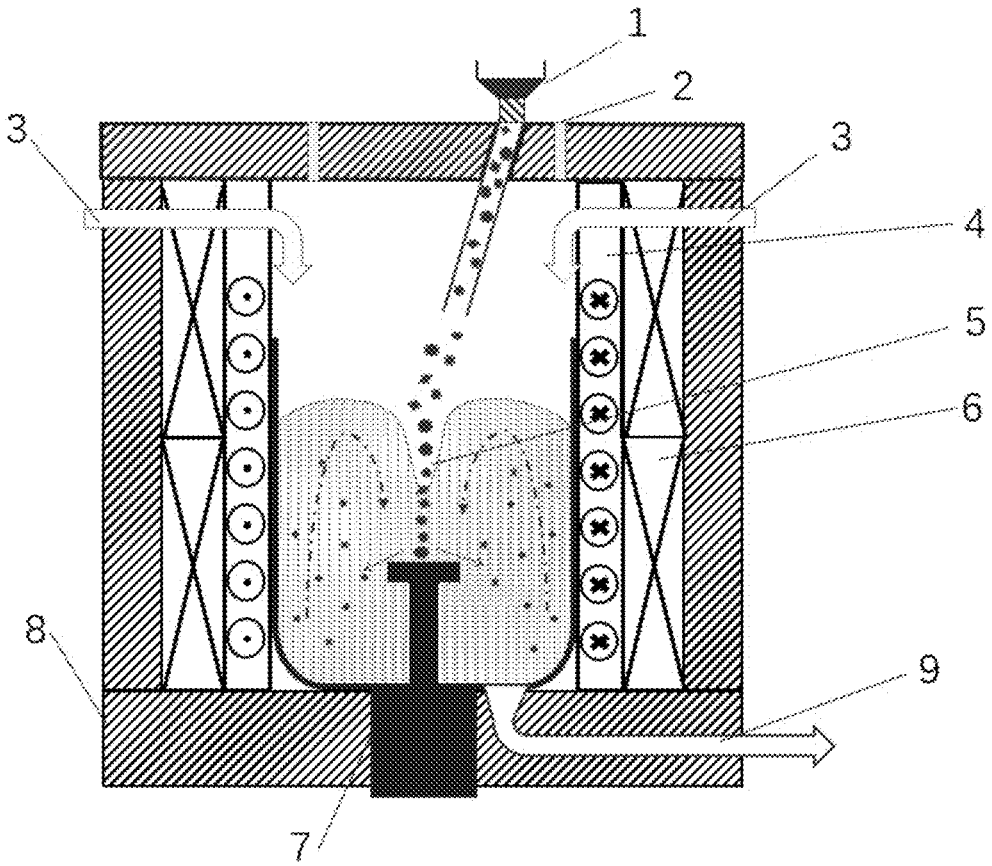
FIG. 1 is a structural schematic diagram of the integrated composite preparation apparatus that couples a radial magnetic field and an ultrasonic field according to the present invention, where 1 represents a feeder, 2 represents an air outlet, 3 represents an argon ventilation pipe, 4 represents an electromagnetic induction heating device, 5 represents a siphon channel, 6 represents a radial magnetic field device, 7 represents an ultrasonic device, 8 represents a melting furnace protective layer, and 9 represents a discharge port.
Figure 2:
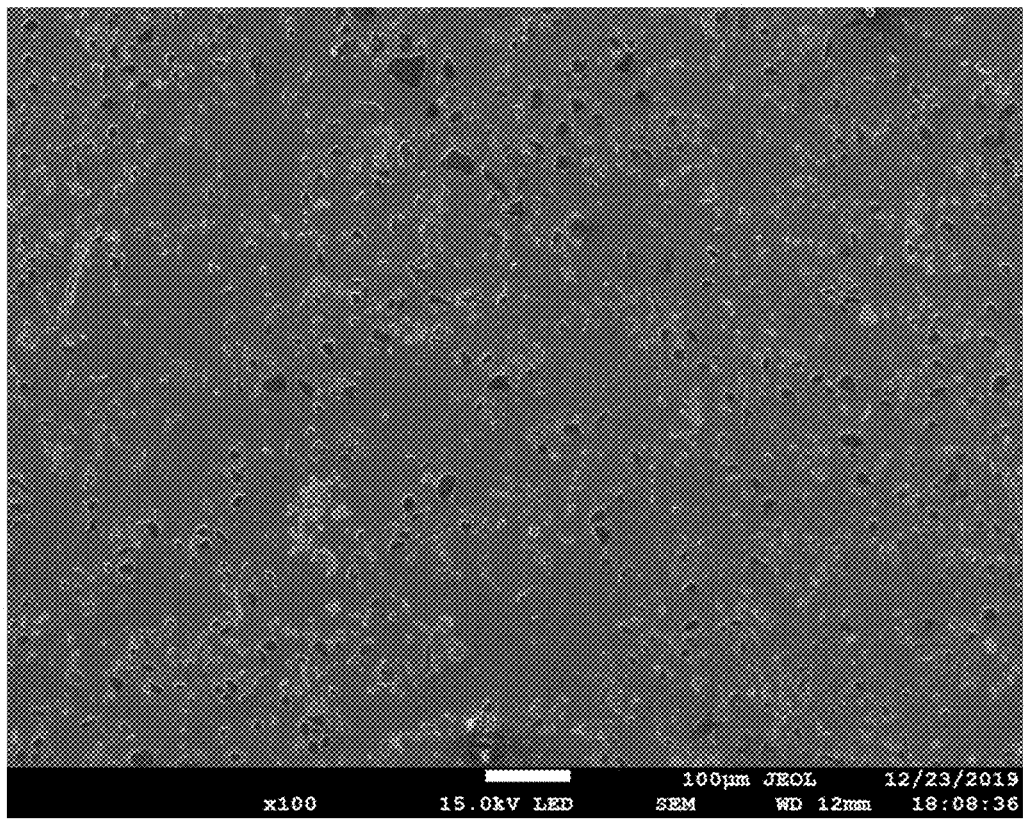
FIG. 2 is a scanning electron microscopy (SEM) image of the (5 vol % $B_4C$+1 vol % $ZrB_2$)/Al composite prepared by the apparatus designed in the present invention.

FIG. 2 is an SEM image of the (5 vol % $B_4C$+1 vol % $ZrB_2$)/Al composite prepared by the apparatus designed in the present invention, and it can be seen from image that $B_4C$ particles enter the matrix and are uniformly dispersed.

Example 2

Al—Hf and Al—B alloys were used as reactants, 6016 aluminum was used as a matrix, and a chemical composition enabling the production of 0.5 vol % $HfB_2$ nanoparticles was adopted. 6016 aluminum was placed in a crucible and heated by an induction coil for melting, and after the temperature reached 870° C., the Al—Hf and Al—B alloys were added. A radial magnetic field device and an ultrasonic device were turned on with a radial magnetic field power of 110 kW, a current of 45 A, and an ultrasonic field power of 13 kW to conduct a reaction for 30 min. After a melt was cooled to 780° C. to 800° C., $B_4C$ particles with an average particle size of 15 μm were added at a speed of 20 g/min, and after a reaction was completed, a resulting melt was allowed to stand, then subjected to gas removal and slag removal, cooled to 720° C., and casted to finally obtain a (10 vol % $B_4C$+0.5 vol % $HfB_2$)/6016Al composite. The composite had a tensile strength of 380 MPa, a yield strength of 260 MPa, and an elongation at break of 16.5%.

Example 3

Al—Ti and $B_2O_3$ alloys were used as reactants, 6082 aluminum was used as a matrix, and a chemical composition enabling the production of 0.3 vol % $TiB_2$ nanoparticles was adopted. 6082 aluminum was placed in a crucible and heated by an induction coil for melting, and after the temperature reached 870° C., the Al—Ti and $B_2O_3$ alloys were added. A radial magnetic field device and an ultrasonic device were turned on with a radial magnetic field power of 110 kW, a current of 45 A, and an ultrasonic field power of 13 kW to conduct a reaction for 30 min. After a melt was cooled to 780° C. to 800° C., $B_4C$ particles with an average particle size of 10 μm were added at a speed of 20 g/min, and after a reaction was completed, a resulting melt was allowed to stand, then subjected to gas removal and slag removal, cooled to 720° C., and casted to finally obtain a (15 vol % $B_4C$+0.3 vol % $TiB_2$)/6082Al composite. The composite had a tensile strength of 396 MPa, a yield strength of 273 MPa, and an elongation at break of 12.3%.

Example 4

Al—Cd and Al—B alloys were used as reactants, A356 aluminum was used as a matrix, and a chemical composition enabling the production of 0.5 vol % CdB nanoparticles was adopted. A356 aluminum was placed in a crucible and heated by an induction coil for melting, and after the temperature reached 870° C., the Al—Cd and Al—B alloys were added. A radial magnetic field device and an ultrasonic device were turned on with a radial magnetic field power of 110 kW, a current of 45 A, and an ultrasonic field power of 13 kW to conduct a reaction for 30 min. After a melt was cooled to 780° C. to 800° C., $B_4C$ particles with an average particle size of 15 μm were added at a speed of 20 g/min, and after a reaction was completed, a resulting melt was allowed to stand, then subjected to gas removal and slag removal, cooled to 720° C., and casted to finally obtain a (10 vol % $B_4C$+0.5 vol % CdB)/A356 composite. The composite had a tensile strength of 310 MPa, a yield strength of 220 MPa, and an elongation at break of 7.5%.

What is claimed is:

1. A method for preparing an aluminum matrix composite (AMC), wherein through a siphon channel in a center of a melt surface generated by a radial magnetic field, a micro-$B_4C$ extrinsic ceramic reinforcement and an intermediate alloy or compound with one or more selected from the group consisting of B, Cd, Hf, Ti, and Zr are introduced into a melt, and a temperature and a pressure caused by cavitation and acoustic streaming generated through an ultrasonic field below a liquid surface of the siphon channel help to achieve infiltration and dispersion of the micro-$B_4C$ extrinsic ceramic reinforcement and promote generation of an in-situ nano-reinforcement from the intermediate alloy or compound with one or more selected from the group consisting of B, Cd, Hf, Ti, and Zr and uniform dispersion of the in-situ nano-reinforcement, such that the aluminum matrix composite reinforced by a cross-scale hybrid of the micro-$B_4C$ extrinsic ceramic reinforcement and the in-situ nano-reinforcement is prepared, wherein a micro-$B_4C$ powder of the micro-$B_4C$ extrinsic ceramic reinforcement comprises $B_4C$ microparticles with a $B_4C$ content of 98.8 wt % or more and an average particle size of 10 μm to 300 μm, and a volume fraction of the $B_4C$ microparticles in the AMC is 5 vol % to 30 vol %, and wherein the in-situ nano-reinforcement with one or more selected from the group consisting of B, Cd, Hf, Ti, and Zr comprises one or more selected from the group consisting of $ZrB_2$, $TiB_2$, CdB, and $HfB_2$ that are generated by introducing different intermediate alloys or reactants in the melt for an in-situ reaction, the in-situ nano-reinforcement comprises in-situ nano-reinforcement particles with a particle size of 2 nm to 100 nm; and a volume fraction of the in-situ nano-reinforcement particles in the AMC is 0.2 vol % to 25 vol %, the method specifically comprises the following steps:

step 1: melting a matrix aluminum alloy in a crucible of an integrated composite preparation apparatus at 850° C. to 950° C. to obtain a melt;

step 2: turning on a radial magnetic field device and an ultrasonic device of the integrated composite preparation apparatus, and adding the intermediate alloy or compound with one or more selected from the group consisting of B, Cd, Hf, Ti, and Zr mixed in a predetermined ratio through a feed pipe to conduct a reaction for 20 min to 30 min, to generate the in-situ nano-reinforcement; and step 3: cooling the melt to 780° C. to 800° C., adding the $B_{4C}$ microparticles through the feed pipe, and applying the radial magnetic field and the ultrasonic field to promote infiltration and dispersion of the $B_4C$ microparticles in the composite melt; and stirring for 10 min to 30 min, cooling to 720° C. to 750° C., followed by casting.

2. The method according to claim 1, wherein the matrix aluminum alloy is heated by an electromagnetic induction heating device, and the radial magnetic field device and the ultrasonic device are used to promote synthesis of the in-situ nano-reinforcement particles and the infiltration and dispersion of the $B_4C$ microparticles.

3. The method according to claim 1, wherein the siphon channel in the center of the melt surface generated by the radial magnetic field is generated due to flow inside the melt caused by the radial magnetic field; and the radial magnetic field has a power of 80 kW to 160 kW and a current of 10 A to 100 A, and the siphon channel has a depth of 5 cm to 15 cm.

4. The method according to claim 1, wherein the ultrasonic field is generated by the ultrasonic device at a bottom of the integrated composite preparation apparatus, with an ultrasonic power of 5 kW to 20 kW; and an amplitude transformer has a length of 10 cm, and there is a distance of 8 cm to 15 cm between a top of the amplitude transformer and a bottom of the siphon channel, and the amplitude transformer is made of a niobium alloy.

5. The method according to claim 1, wherein the matrix aluminum alloy in the step 1 is selected from the group consisting of 2xxx, 5xxx, 6xxx, and 7xxx series aluminum matrices according to different uses of thermal conduction, electric conduction, high strength, low expansion, and wear resistance; and in the step 2, a feed speed of the feed pipe is controlled at 5 g/min to 50 g/min by a mechanical device.

6. The method according to claim 1, wherein the melting at 850° C. to 950° C. in the step 1 is adjusted according to a specific reaction system; the in-situ reaction is conducted for 20 min to 30 min to introduce the intermediate alloy or compound for forming the in-situ nano-reinforcement particles into the melt, and the in-situ reaction is accompanied by radial cyclic stirring, such that the in-situ nano-reinforcement is synthesized in-situ in the melt; the intermediate alloy or compound for forming the in-situ nano-reinforcement particles comprises one or more selected from the group consisting of Al—Zr, Al—Ti, Al—B, Al—Cd, Al—Hf, $K_2ZrF_6$, $K_2TiF_6$, $KBF_4$, $Na_2B_4O_7$, $ZrO_2$, and $B_2O_3$; and the crucible is made of a heat-resistant die steel undergoing a surface passivation treatment.

* * * * *